United States Patent [19]

Nordmann

[11] Patent Number: 4,730,536

[45] Date of Patent: Mar. 15, 1988

[54] METHOD AND APPARATUS FOR MOVING CARTRIDGED AMMUNITION FROM A HULL MAGAZINE TO A TURRET MAGAZINE

[75] Inventor: Adolf Nordmann, Erkrath, Fed. Rep. of Germany

[73] Assignee: Rheinmetall GmbH, Düsseldorf, Fed. Rep. of Germany

[21] Appl. No.: 6,495

[22] PCT Filed: Mar. 20, 1986

[86] PCT No.: PCT/EP86/00159

§ 371 Date: Jan. 12, 1987

§ 102(e) Date: Jan. 12, 1987

[87] PCT Pub. No.: WO86/06826

PCT Pub. Date: Nov. 20, 1986

[30] Foreign Application Priority Data

May 11, 1985 [DE] Fed. Rep. of Germany ..... 3517056

[51] Int. Cl.[4] ..... F41D 10/38

[52] U.S. Cl. ..... 89/45; 89/47; 89/36.13; 89/34

[58] Field of Search ..... 89/45, 46, 47, 33.05, 89/36.13

[56] References Cited

U.S. PATENT DOCUMENTS

| | | | |
|---|---|---|---|
| 2,905,056 | 9/1959 | Nectoux | 89/45 |
| 4,326,446 | 4/1982 | Magnuson | 89/45 |
| 4,398,477 | 8/1983 | Harris et al. | 89/46 |
| 4,632,011 | 12/1986 | Metz et al. | 89/46 |

FOREIGN PATENT DOCUMENTS

| | | | |
|---|---|---|---|
| 0017591A2 | 4/1980 | European Pat. Off. | 89/45 |
| 1301742 | 4/1970 | Fed. Rep. of Germany | 89/36.13 |
| 2818279 | 8/1979 | Fed. Rep. of Germany | 89/45 |
| 2288292 | 5/1976 | France | 89/45 |

*Primary Examiner*—Stephen C. Bentley
*Assistant Examiner*—Stephen M. Johnson
*Attorney, Agent, or Firm*—Spencer & Frank

[57] ABSTRACT

To reduce the space required within the rotatable turret housing 24 of an armored vehicle for transferring cartridged ammunition 3 from a magazine 4 in the hull to a magazine 10 in the turret, the gun barrel 1, which is pivotal about a cradle axis 2, is used as a transporting means for the change of ammunition. To transport the cartridged ammunition 3 into the chamber 15 of the gun barrel, the ammunition 3 of the hull magazine 4 in the removal position 5 is arranged at an angle within vehicle hull 23 so that the ammunition 3 forms a straight line 7 with the bore axis 6 of the gun barrel 1, which has been raised by an elevation angle α with respect to the horizontal. To guide the cartridged ammunition 3 in the region of the recoil path s of the barrel 1, pivotal conduits or spacers 11, 12 are fastened to hull magazine 4 and to turret magazine 10. The gun barrel 1 serves as the transporting means, on the one hand, to replenish the cartridged ammunition 3 in the turret magazine 10 from the supply of ammunition in the hull magazine 4 and, on the other hand, to replenish the hull magazine 4 in the reverse direction of transport. For the longitudinal transport of the cartridged ammunition 3 into and out of chamber 15 of gun barrel 1, ramming devices 16, 17 are provided at turret magazine 10 and at hull magazine 4, respectively.

7 Claims, 2 Drawing Figures

METHOD AND APPARATUS FOR MOVING CARTRIDGED AMMUNITION FROM A HULL MAGAZINE TO A TURRET MAGAZINE

BACKGROUND AND SUMMARY OF THE INVENTION

The invention relates to an arrangement for changing cartridged ammunition from the hull magazine to the turret magazine of an armored vehicle which is equipped with a gun barrel.

Such a conveying device is known from German Offenlegungsschrift 2,818,279; however, it has the drawback that it requires a considerable amount of space within the turret.

In view of this, it is the object of the invention to provide an arrangement for changing cartridged ammunition from the hull magazine to the turret magazine of an armored vehicle, which arrangement considerably reduces the space required within the turret for a change of ammunition.

This is accomplished by employing the gun barrel, which is pivotal about a cradle axis, as the transporting means for changing or transferring the cartridged ammunition from the hull magazine to the turret magazine.

In an advantageous manner, the invention permits the use of the gun barrel as a space saving transporting means for moving the cartridged ammunition from the hull magazine to the turret magazine of an armored vehicle. In a particularly advantageous manner no additional drives and power connections are required for the ammunition changing arrangement other than the already-existing elevation height setting drive of the gun barrel.

Since the transporting chamber for the cartridged ammunition during a change of ammunition is the loading chamber of the gun barrel, and since the gun can be loaded directly and automatically from the hull magazine as it is possible with turret magazines, the weapon is ready for fire even during a change of ammunition. The direct loading from the hull magazine, which additionally saves space, is made possible because when the cartridge ammunition is in the removal position in the hull magazine, it is disposed in an oblique position within the vehicle hull, or else the entire hull magazine is disposed obliquely. In its oblique orientation for removal from the hull magazine, the cartridged ammunition forms a straight line with the bore axis of the gun barrel, which has been raised by an elevation angle $\alpha$ with respect to the horizontal so that the cartridged ammunition can be transported directly into the chamber of the gun barrel. Transfer of the cartridged ammunition into the chamber is facilitated by a conduit or spacer which bridges the gun recoil path and by a ramming device fixed to the hull magazine.

For barrel recoil, the spacers disposed at the turret magazine as well as at the hull magazine can be pivoted out of the bridging position. The upper side of the tubular spacer disposed at the hull magazine has a concave or bowl-shaped configuration and, in its lowered position, is adapted to the recoil chamber of the gun barrel, thus shortening the distance between the hull magazine and the gun barrel and, in a further advantageous manner, reducing the space required in the turret.

DESCRIPTION OF THE PREFERRED EMBODIMENT

Figure 1:
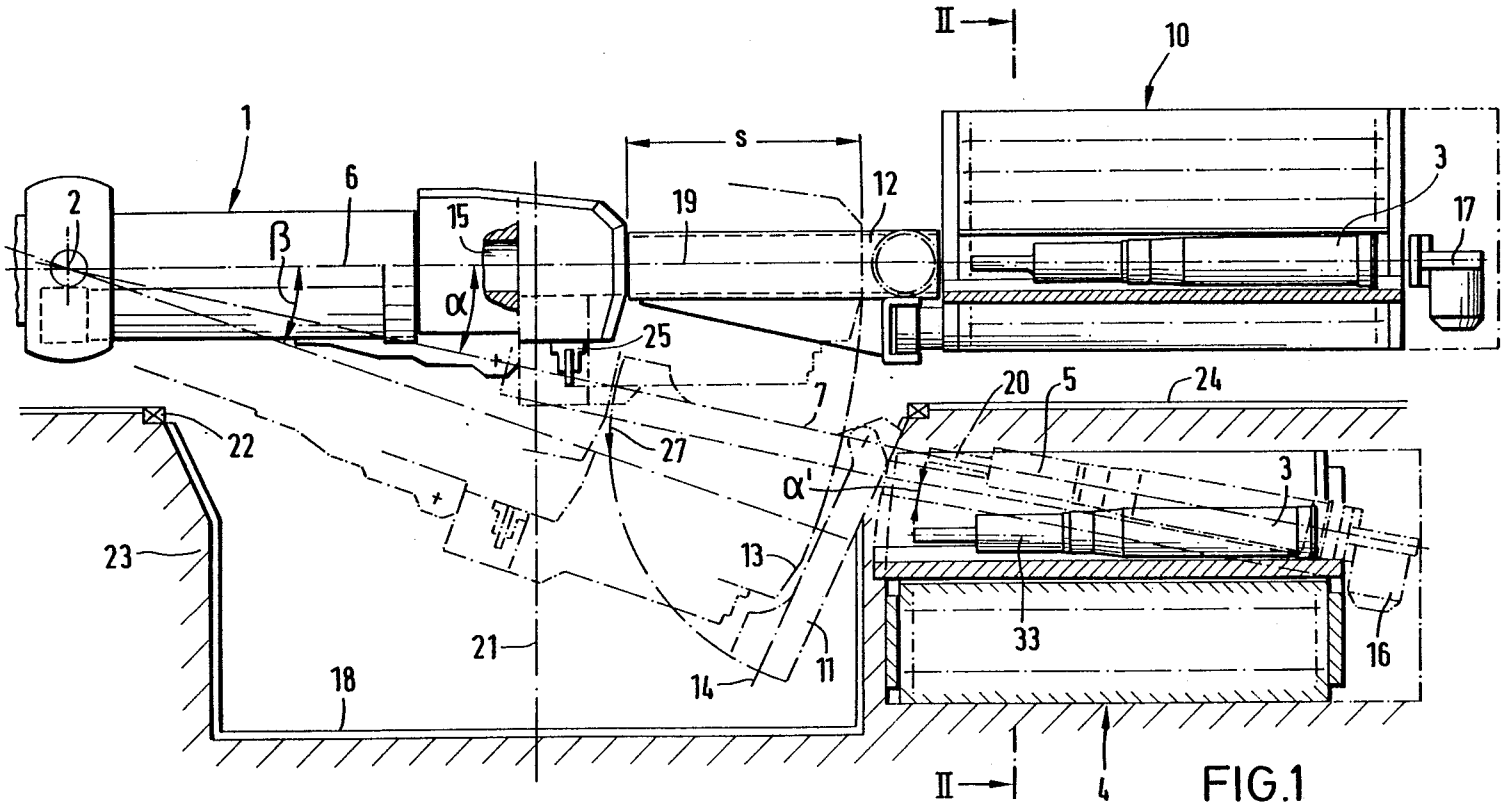
FIG. 1 is a partially sectional side view of a portion of a turret, and generally illustrates a gun barrel which is pivotal about a cradle axis, the gun barrel serving as a transporting means for moving cartridged ammunition between a transfer position at the turret magazine and a removal position (shown in dash-dot lines) at the hull magazine.

FIG. 1 shows the arrangement of a known gun barrel 1 which is arranged so as to be pivotal in the elevation direction, about a cradle axis 2, within a turret which is rotatable about an azimuth axis 21. The turret housing 24, which is not shown in detail in its lateral and upper region, is connected by way of a ring bearing 22 with the hull 23 of an armored vehicle, likewise not shown in detail. Within turret housing 24, behind gun barrel 1, there are a plurality of turret magazines 10 (FIG. 2) in which cartridged ammunition 3 is disposed in an orientation horizontal and parallel to the azimuth position of gun barrel 1. Such a turret magazine 10 is disclosed, for example, in German Pat. No. 1,301,742. To assure guidance of the cartridged ammunition 3 during the loading process also in the region of the recoil path s of gun barrel 1, a conduit or spacer 12 in the form of a tube is disposed between turret magazine 10 and gun barrel 1. During recoil of the weapon, spacer 12 can be pivoted away to the side.

The cartridged ammunition 3 is conveyed by means of a known ramming device 17, which may, for example, be a chain rammer, along the bore axis 6 and into the chamber 15 of gun barrel 1. When the wedge-type breech block 25 of gun barrel 1 is open, ramming device 17 is also able to pull cartridged ammunition 3 disposed in chamber 15 into the receiving position 9 of the turret magazines 10 disposed at both sides of receiving position 9 (FIG. 2A).

In the lateral outer region of turret cradle 18, within vehicle hull 23, a hull magazine 4 is disposed. As is shown in FIG. 2B, hull magazine 4 is composed, for example, of an endless conveyor chain 28 in which further cartridged ammunition 3 is stored for replenishment of turret magazines 10. The gun barrel 1, which is pivotal about cradle axis 2, serves as the transporting means for moving the cartridged ammunition 3 from hull magazine 4 to turret magazine 10. The cartridged ammunition 3 in the removal position 5 in hull magazine 4 (or the entire hull magazine 4) is arranged in an oblique orientation within vehicle hull 23 so that, for removal, the gun barrel 1 is raised by an elevation angle $\alpha$ with respect to the horizontal 19 and the cartridged ammunition 3 forms a straight line 7 with the bore axis 6 of gun barrel 1. The ammunition removal position 5 of hull magazine 4 then lies on the longitudinal axis 8 of the vehicle. Hull magazine 4 has its own ramming device 16 fastened to the rear end of the magazine 4 for removing the ammunition 3, which is oriented with the ammunition tip 20 facing the gun barrel 1.

To realize the oblique position of the cartridged ammunition 3, either the illustrated hull magazine 4 is arranged so as to be inclined by the angle $\alpha'$ or a rotary drive (not shown) is provided at hull magazine 4 to pivot the cartridged ammunition 3 from its horizontal position 33 up into the removal position 5.

Hull magazine 4 is also provided with a pivotal tubular conduit or spacer 11 to bridge the recoil path s. In contrast to spacer 12 of turret magazine 10, which is fixed to the turret, spacer 11 is not rotatable about azimuth axis 21 but is fixed to the hull 23 at the transition where the hull 23 changes to the turret cradle 18 and, to assure recoil of the barrel 1, can be pivoted out of the way downwardly. During intake of cartridged ammunition 3 into chamber 15 of gun barrel 1 and during removal of cartridged ammunition 3 from chamber 15, the longitudinal axis of spacer 11 forms a straight line with the axis of cartridged ammunition 3 in the removal position 5 and with the bore axis 6 of the gun barrel 1 elevated by the angle $\alpha$. To shorten the distance between the recoiled gun barrel 1 and hull magazine 4 and thus to reduce the space required for turret cradle 18, the upper side of spacer 11 is given a concave or bowl shape and, in its position 14 where it is pivoted downwardly in the direction of arrow 27, it is adapted to the space 13 available for recoil of gun barrel 1. Spacer 11 is here given such a configuration that it is possible to elevate the barrel 1 beyond angle $\alpha$ by an angle $\beta$.

Figure 2:
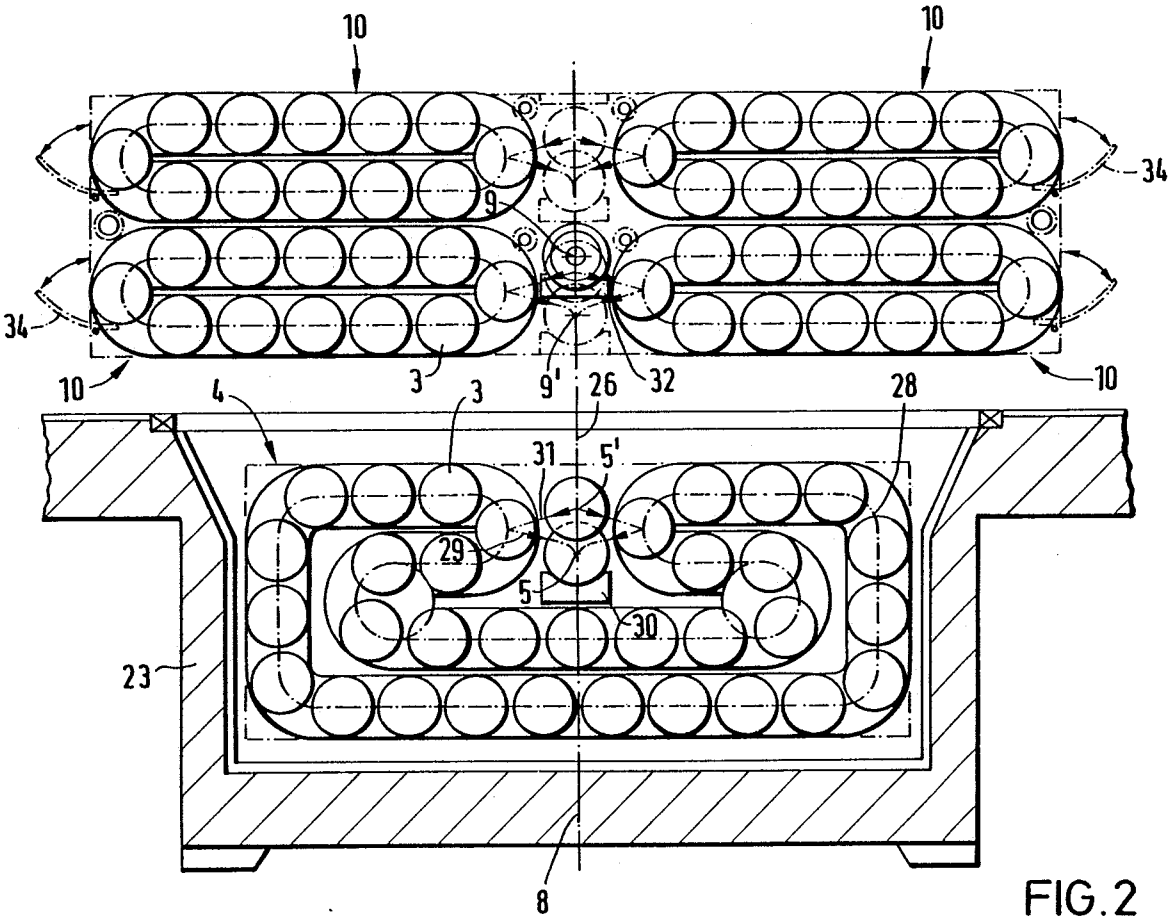
FIGS. 2A and 2B together represent a sectional view, along line II—II of FIG. 1, of the hull and turret magazines.

For the process of changing the cartridged ammunition 3 from hull magazine 4 to turret magazine 10 it is necessary for gun barrel 1 to be oriented in azimuth in a plane 26 containing the longitudinal axis 8 of the vehicle (FIGS. 2A and 2B and elevated by an angle $\alpha$ so that it is advisable to perform this process during a pause in combat. After the cartridged ammunition 3 has been supplied to chamber 15 by ramming device 16, gun barrel 1 pivots it upwardly in plane 26 by an angle $\alpha$ so that ramming device 17 disposed at turret magazine 10 is able to pull the cartridged ammunition 3 into the receiving position 9 shown in FIG. 2.

To fill the hull magazine 4, the transporting sequence of the cartridged ammunition 3 takes place in the reverse sequence.

FIG. 2 shows the arrangement of a hull magazine 4 in the vehicle hull 23 and two superposed turret magazines 10 at the turret on both sides of receiving position 9.

In the case where cartridged ammunition 3 is to be moved from hull magazine 4 to turret magazine 10, ammunition 3 leaves conveyor chain 28 obliquely downwardly under its own weight in the direction of arrow 29 to take up the removal position 5. Ammunition 3 can then be removed selectively from the left or the right of conveyor chain 28 of hull magazine 4.

To permit the intake of ammunition into hull magazine 4 in just as easy a manner, a retainer 30 for maintaining the removal position 5 in plane 26 is arranged so as to be displaceable (not shown), thus making it possible to supply cartridged ammunition 3 under its own weight from an upper supply position 5' likewise selectively from the left or the right to hull magazine 4 in an obliquely downward direction as shown by arrow 31.

Similarly, retainer 32 for receiving position 9 of turret magazine 10 is arranged to be downwardly displaceable in plane 26 to take on the removal position 9' for the removal of cartridged ammunition 3 from the lower turret magazine 10, with retainer 32 being arranged to be displaceable in plane 26 until it reaches the upper receiving or removal position, respectively, so as to supply the upper turret magazine 10.

At their outer sides, turret magazines 10 are each provided with pivotal insertion flaps 34 for replenishment of cartridged ammunition 3.

By using the gun barrel 1 as transporting means for the automatic change of cartridged ammunition 3 from the hull magazine 4 to the turret magazine 10, there results, in addition to a considerable savings in space within turret housing 24, a substantial, advantageous reduction of weight compared to prior art arrangements.

What I claim is:

1. In a method for moving cartridged ammunition from a magazine in the hull to a magazine in the turret of an armored vehicle having a gun barrel which has a chamber and which is pivotal about a cradle axis, the turret magazine being disposed above the hull magazine and being pivotal about an azimuth axis, the improvement comprising: employing the chamber of the gun barrel as a transporting means for swinging the cartridged ammunition upward from the hull magazine toward the turret magazine, with the turret magazine receiving the chambered ammunition in an orientation horizontal to the azimuth axis.

2. A method according to claim 1, wherein the gun barrel has a bore axis, wherein the armored vehicle has a vehicle hull, and wherein each cartridged ammunition has a respective axis, and further comprising disposing a predetermined cartridged ammunition which is in the hull magazine at an oblique position within the vehicle hull for removal from the hull magazine, and pivoting the gun barrel with respect to the horizontal so that the bore axis of the gun barrel coincides with the axis of the predetermined cartridged ammunition.

3. A method according to claim 1, wherein the armored vehicle has a longitudinal axis, wherein each cartridged ammunition has a respective tip, and wherein the hull magazine is provided with its own ramming device and has an ammunition removal position which lies on the longitudinal axis of the armored vehicle, and further comprising removing a chambered ammunition, which is disposed at the ammunition removal position of the hull magazine and which is oriented with its tip toward the gun barrel, from the hull magazine using said hull magazine ramming device.

4. A method according to claim 1, wherein the gun has a bore axis and recoils along a recoil path when the cartridged ammunition is fired, and wherein, in order to bridge the recoil path of the barrel during the supplying of cartridged ammunition into the chamber of the gun barrel and removal of the cartridged ammunition from the chamber when the barrel is employed as a transporting means for moving the cartridged ammunition, pivotable conduits are fastened at the turret magazine and at the hull magazine, respectively, and further comprising pivoting the conduits to a respective horizontal orientation and to an oblique position depending upon the position of the bore axis when the barrel is employed as a transporting means.

5. A method according to claim 4, wherein the conduits have a tubular configuration, and wherein the conduit which is fastened at the hull magazine is disposed at a down position when the barrel recoils and has a concave side to accommodate the end of the barrel during the recoil, and further comprising pivoting the conduit which is fastened at the hull magazine to an up position before employing the barrel as a transporting means for moving the cartridged ammunition.

6. A method according to claim 1, wherein the chamber of the gun barrel is employed as the sole transporting means for swinging the cartridged ammunition upward from the hull magazine toward the turret magazine.

7. An apparatus, for use in an armored vehicle having a gun barrel which is pivotal about a cradle axis and having hull and turret magazines, to move cartridged ammunition from the hull magazine to the turret magazine, the gun having a chamber and a bore axis and recoiling along a recoil path when the ammunition is fired, said apparatus comprising:

first conduit means, pivotally mounted at the hull magazine and selectively movable between raised and lowered positions, for bridging the recoil path and guiding a predetermined cartridged ammunition from the hull magazine to the chamber of the gun when the bore axis is disposed at a first angular position and the first conduit means is in its raised position, the first conduit means having an upper side with a concavity into which the recoil path can extend when the first conduit means is in its lowered position; and second conduit means, pivotally mounted at the turret magazine and selectively movable between extended and withdrawn positions, for bridging the recoil path and guiding the predetermined cartridged ammunition from the chamber of the gun to the turret magazine when the bore axis is disposed at a second angular position and the second conduit means is in its extended positon.

* * * * *